US008760359B2

(12) United States Patent
Sato et al.

(10) Patent No.: US 8,760,359 B2
(45) Date of Patent: Jun. 24, 2014

(54) RADOME OF CANAPE STRUCTURE

(75) Inventors: Hiroyuki Sato, Tokyo (JP); Takashi Iwakura, Tokyo (JP); Akihiko Nishizaki, Fukushima (JP); Toshio Ikeda, Fukushima (JP)

(73) Assignee: Mitsubishi Electric Corporation, Tokyo (JP)

( * ) Notice: Subject to any disclaimer, the term of this patent is extended or adjusted under 35 U.S.C. 154(b) by 136 days.

(21) Appl. No.: 13/497,304

(22) PCT Filed: Oct. 12, 2010

(86) PCT No.: PCT/JP2010/067837
§ 371 (c)(1),
(2), (4) Date: Mar. 21, 2012

(87) PCT Pub. No.: WO2011/046100
PCT Pub. Date: Apr. 21, 2011

(65) Prior Publication Data

US 2012/0188145 A1 Jul. 26, 2012

(30) Foreign Application Priority Data

Oct. 14, 2009 (JP) ..... 2009-237299

(51) Int. Cl.
*H01Q 1/42* (2006.01)

(52) U.S. Cl.
CPC ..... *H01Q 1/422* (2013.01); *H01Q 1/424* (2013.01)
USPC ..... 343/872; 343/907

(58) Field of Classification Search
CPC ..... H01Q 1/422; H01Q 1/424
USPC ..... 343/872, 907, 897
See application file for complete search history.

(56) References Cited

U.S. PATENT DOCUMENTS 5,408,244 A 4/1995 Mackenzie
6,028,565 A * 2/2000 Mackenzie et al. ..... 343/872
(Continued)

FOREIGN PATENT DOCUMENTS

EP 2 068 397 A2 6/2009
EP 2 068 397 A3 6/2009
(Continued)

OTHER PUBLICATIONS

International Search Report Issued Jan. 11, 2011 in PCT/JP10/67837 filed Oct. 12, 2010.
(Continued)

*Primary Examiner* — Hoanganh Le
(74) *Attorney, Agent, or Firm* — Oblon, Spivak, McClelland, Maier & Neustadt, L.L.P.

(57) ABSTRACT

A radome not having a sandwich structure but having a canape structure is formed with an object to obtain a radome of a canape structure having a satisfactory radio property, and moreover, an excellent mechanical strength by providing a matching layer to a skin layer on an interior side of a radome. The skin layer is formed of layered glass fiber cloths and resin impregnated therein. The layered glass fiber cloths can be replaced with glass fiber mats. For the matching layer, a foamed material, such as a urethane material having a low permittivity, or a core material having a resin impregnating property can be used. A radome of a canape structure can be obtained with the skin layer and the matching layer.

4 Claims, 7 Drawing Sheets

(56) References Cited

U.S. PATENT DOCUMENTS

| | | | | |
|---|---|---|---|---|
| 6,107,976 | A * | 8/2000 | Purinton | 343/872 |
| 7,420,523 | B1 | 9/2008 | Ziolkowski et al. | |
| 2009/0148681 | A1 | 6/2009 | Utsumi et al. | |

FOREIGN PATENT DOCUMENTS

| | | |
|---|---|---|
| JP | 7 142917 | 6/1995 |
| JP | 2004 200895 | 7/2004 |
| JP | 2007 247255 | 9/2007 |
| JP | 2009 141736 | 6/2009 |

OTHER PUBLICATIONS

Extended European Search Report issued May 10, 2013 in Patent Application No. 10823368.5.

* cited by examiner

FIG.6

EXAMPLE OF RADOME OF CANAPE STRUCTURE

| | | MATERIAL | PHYSICAL PROPERTIES | ELECTRICAL PROPERTY | | REMARKS |
|---|---|---|---|---|---|---|
| | | | MECHANICAL CHARACTERISTIC | PERMITTIVITY/ DIELECTRIC TANGENT | ERROR LOSS dB | |
| RADOME PRODUCT | SKIN LAYER | ①2 LAYERS -②2 LAYERS -①2 LAYERS (① =NEA2116, ②=Dyneema) | TENSILE STRENGTH 263MPa BENDING STRENGTH 349MPa | | 0.4dB typ @14GHz | THICKNESS: ABOUT 2mm |
| | MATCHING LAYER | LANTOR SORIC XF | (ACTUAL MEASURED VALUE) TENSILE STRENGTH 4.94MPa BENDING STRENGTH 13.7MPa | PERMITTIVITY 1.95 (INTEGRAL WITH RESIN) DIELECTRIC TANGENT - | | THICKNESS: ABOUT 5mm |
| TEST PIECE | TEST PIECE (1) | NEA2116 (23ply,Vf=66%) | TENSILE STRENGTH3.91MPa BENDING STRENGTH4.91MPa | PERMITTIVITY 3.5 DIELECTRIC TANGENT 0.0095 | – | REFERENCE VALUE |
| | TEST PIECE (2) | Dyneema (7ply,Vf=47.5%) | TENSILE STRENGTH 384MPa BENDING STRENGTH 112MPa | PERMITTIVITY 2.49 DIELECTRIC TANGENT 0.0088 | – | REFERENCE VALUE |
| | RESIN | VINYL ESTER | | PERMITTIVITY 2.72 DIELECTRIC TANGENT 0.0191 | – | REFERENCE VALUE |

NEA2116:NITTO BOSEKI CO., LTD.
REGISTERED TRADEMARK: TOYOBO CO., LTD
LANTOR SORIC XF:LANTOR BV( Soric is a registered trademark)

RADOME OF CANAPE STRUCTURE

TECHNICAL FIELD

The present invention relates to a radome of a canape structure having a canape structure formed of a skin layer and a matching layer and storing an antenna device inside.

BACKGROUND ART

An antenna device that needs protection from an external environment, such as rain, wind, snow, and dust, is normally stored in a radome when put into operation. The radome protecting the antenna device is present in a propagation path of radio waves radiated from an antenna and therefore required to have a good transmitting property and a small amount of reflection. Patent Document 1 discloses a radome of a sandwich structure in which a core material is sandwiched between two skin materials. The skin materials are made of fiber-reinforced plastic (FRP) and the core material is made of urethane. It is described that the radome of Patent Document 1 reduces a transmittivity loss of radio waves caused by the radome by bonding a ¼ wavelength or ¾ wavelength-thick core material between the skin materials.

Patent Document 2 discloses a radome chiefly mounted on aircrafts and having a streamline shape to lessen air resistance. Patent Document 2 points out a problem that when an aircraft takes a low elevation angle, an angle yielded between a communication direction of an antenna and a normal direction to the radome wall surface becomes so large that a power loss increases. According to the radome of Patent Document 2, an antenna device formed of a multi-layer dielectric material is provided in contact with an inner wall of the radome of a sandwich structure in which a core material is sandwiched between skin materials to make the radome function as a kind of sandwich plate, so that a transmitting property to communication power is improved by cancelling out reflected waves from the radome wall.

PRIOR ART DOCUMENTS

Patent Documents

Patent Document 1: JP-A-7-142917
Patent Document 2: JP-A-2004-200895

SUMMARY OF THE INVENTION

Problems that the Invention is to Solve

Radomes described in both of Patent Document 1 and Patent Document 2 have a sandwich structure in which a core material is sandwiched between skin materials and thereby obtain a satisfactory transmitting property to radio waves by appropriately setting a permittivity of the skin materials and a permittivity and a thickness of the core material while maintaining a strength by the skin material. However, in a case where a radome of a sandwich structure having a spherical or streamline shape is manufactured by sandwiching the core material between the skin materials and bonding these materials together, it becomes necessary to form the core material and the two skin materials precisely. Accordingly, there is a problem that the manufacturing costs are increased and the fabrication sequence becomes complicated. Further, radio waves from an antenna have a shorter wavelength as a communication frequency of the antenna becomes higher, for example, as high as a Ku bandwidth (in the neighborhood of 12 GHz). Hence, in order to obtain a desirable transmitting property, required precision for a thickness dimension of the radome becomes stricter. This raises a problem that it becomes more difficult to manufacture a radome of a sandwich structure.

The invention is devised to solve the problems discussed above and has an object to obtain a radome having, not a sandwich structure but a canape structure, which is a radome of a canape structure having a satisfactory radio property, and moreover, an excellent mechanical strength.

A radome of a canape structure according to the invention includes a skin layer shaped like a dome using a glass fiber cloth or a glass fiber mat as reinforcement fibers and formed by impregnating the reinforcement fibers with resin, and a matching layer provided integrally with the skin layer on an inner side of the dome and made of a dielectric material having a lower permittivity than the skin layer.

Advantage of the Invention

According to the invention, the radome has a canape structure formed of the skin layer shaped like a dome and the matching layer made of a dielectric material having a lower permittivity than the skin layer and provided on the inner side of the dome. Hence, the radome can be readily manufactured and a transmitting property to radio waves can be enhanced.

BRIEF DESCRIPTION OF THE DRAWINGS

FIG. 6 is a list showing physical properties of the radome according to Example 1 of the first embodiment.

MODES FOR CARRYING OUT THE INVENTION

First Embodiment

Figure 1:
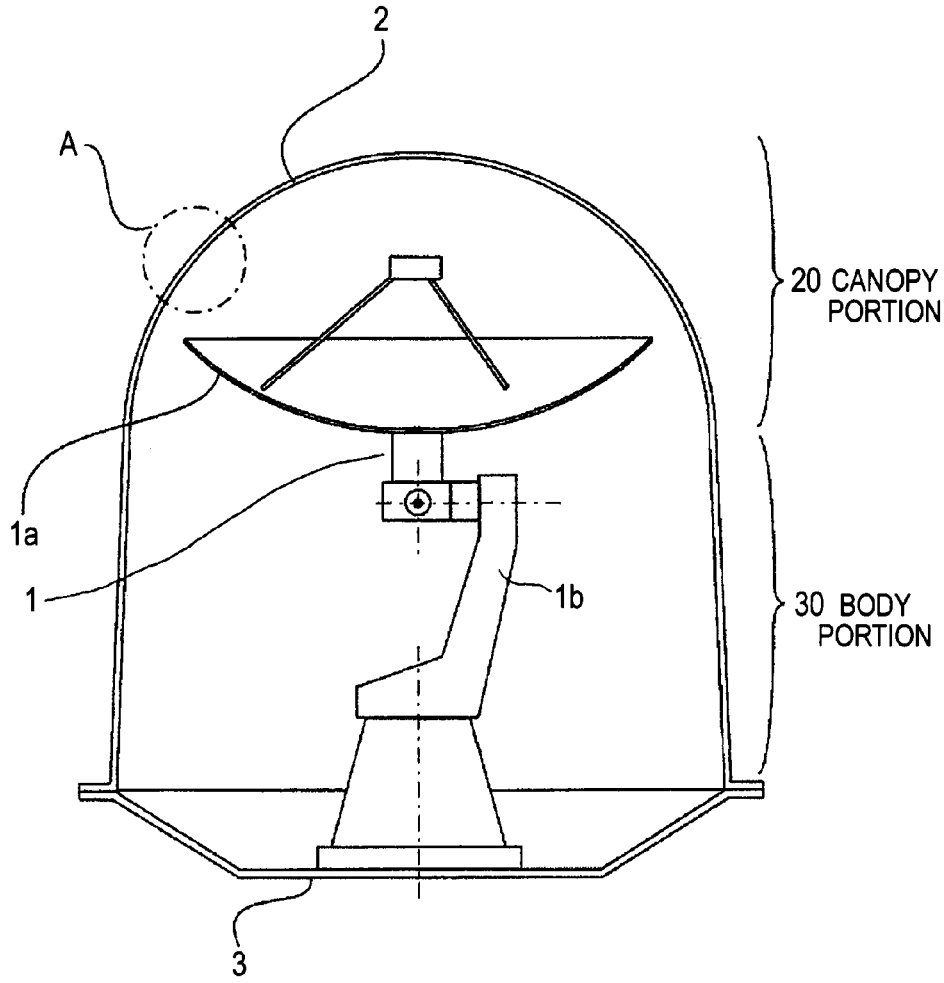
FIG. 1 is a cross section showing the overall configuration of an antenna device using a radome according to a first embodiment of the invention.

A radome of a canape structure according to a first embodiment of the invention will be described on the basis of FIG. 1 through FIG. 5. FIG. 1 is a cross section showing the overall configuration of an antenna device using the radome according to the first embodiment of the invention. Referring to FIG. 1, the antenna device 1 includes a reflector antenna 1*a* and a supporting and driving structure 1*b* thereof and is covered entirely with a radome 2. The antenna device 1 and the radome 2 are installed on a radome stand 3. The antenna device 1 is configured in such a manner that the reflector antenna 1*a* is driven by the supporting and driving structure 1*b* about an orientation axis and an elevation axis. The radome 2 is shaped to have a canopy portion 20 of substantially a hemispherical shape and a body portion 30 of a cylindrical or conical shape so as not to mechanically interfere with the reflector antenna 1*a* within a movable range thereof. Hereinafter, a side of the radome 2 on which the antenna device 1 is stored is referred to as the interior side of the radome 2 and the opposite side is referred to as the exterior side of the radome 2.

The antenna device 1, by being stored in the radome 2, is protected from an external environment, such as rain, wind, snow, and dust. However, because the radome 2 is present in a propagation path of radio waves radiated from the antenna device 1, the radome 2 is required to have a satisfactory transmitting property to radio waves and a small amount of reflection. Also, the radome 2 is required to have a mechanical strength high enough to withstand a load (wind load) and a force of impact (collision of birds or the like) from the external environment.

Figure 2:
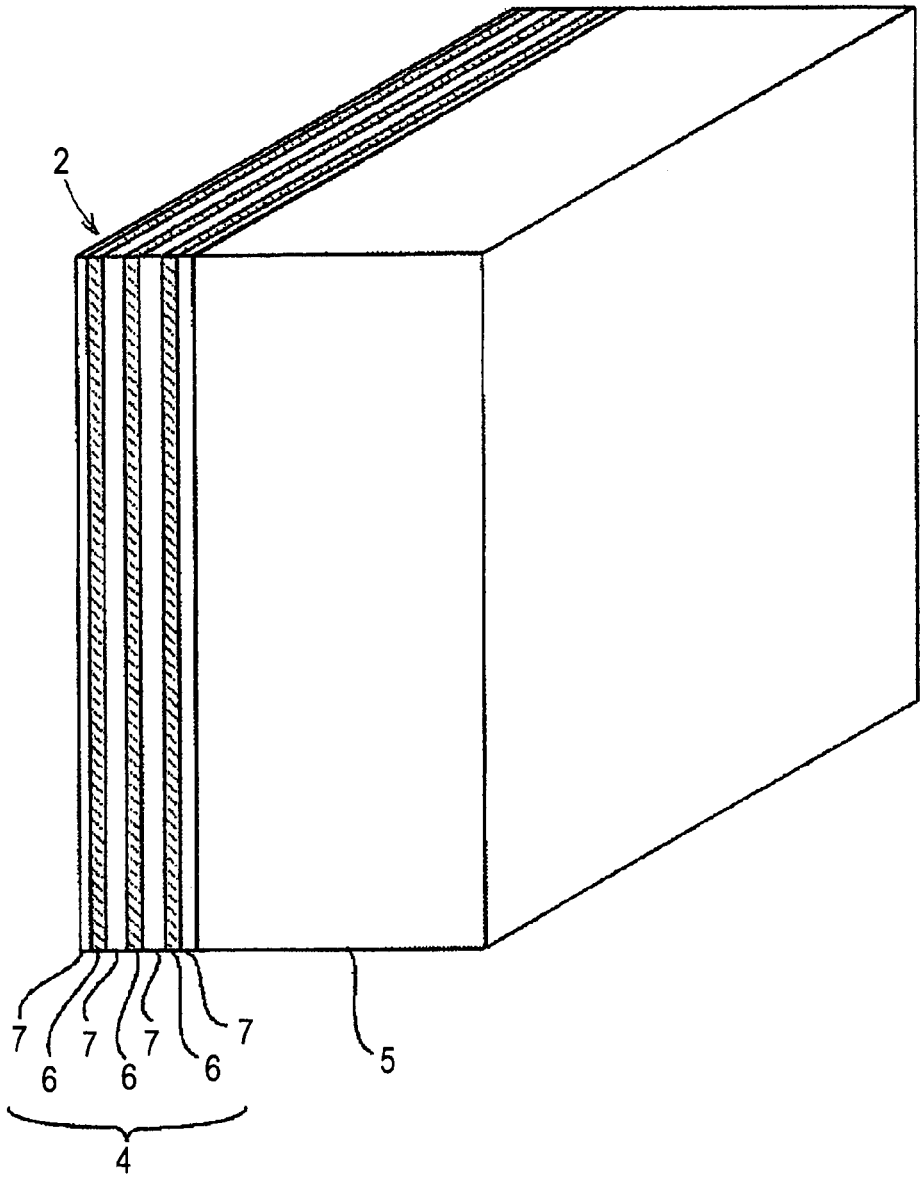
FIG. 2 is a partial perspective cross section of the radome according to the first embodiment of the invention.

FIG. 2 is an enlarged perspective cross section of a portion A of the radome 2 of FIG. 1. Referring to FIG. 2, the radome 2 has a structure in which a skin layer 4 and a matching layer 5 are overlapped each other. Herein, assume that the skin layer 4 is the substrate of the radome 2, then, because the matching layer 5 is provided on one surface of the skin layer 4 as the substrate, this structure of the radome 2 is distinguished from a sandwich structure and referred to as a canape structure. This configuration is different from that of the radome of a sandwich structure in the related art. The radome of a sandwich structure is further provided with a skin layer of substantially the same configuration as the skin layer 4 placed on the matching layer 5 on the interior side of the radome 2 in addition to the configuration of FIG. 2. This structure is referred to as a sandwich structure to mean that a core layer is sandwiched between two skin layers.

The phrase, "a radome of a canape structure", includes all radomes having the structure of FIG. 2 in a finished state after the manufacturing regardless of whether which one of the skin layer 4 and the matching layer 5 is formed first or whether the skin layer 4 and the matching layer 5 are formed simultaneously. In addition, because a surface of the matching layer 5 on the interior side of the radome 2 is exposed to air, a surface layer may be formed by applying coating or laminating a thin film thereon for the purpose of providing protection. This surface layer, however, is additional and a radome structure in which the surface layer is formed on the matching layer 5 is not referred to as a sandwich structure and included in radomes of a canape structure.

Figure 3:
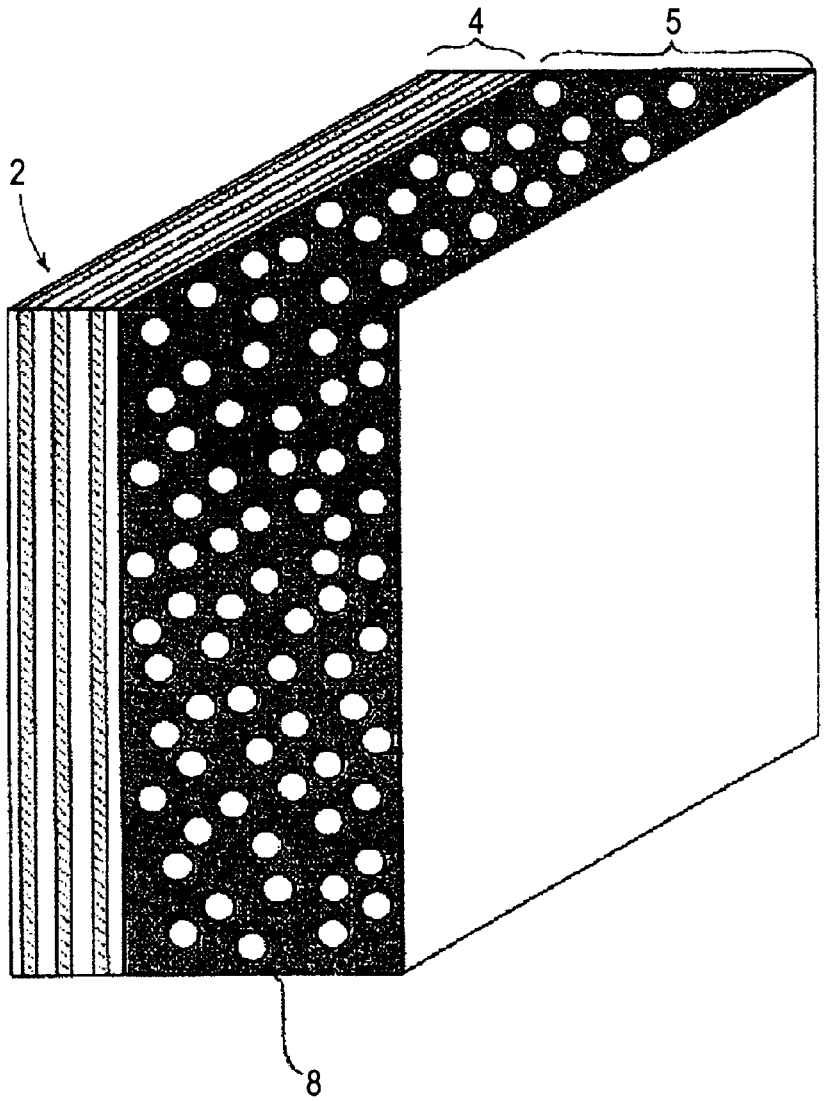
FIG. 3 is a partial perspective cross section using a foamed material as a matching layer of the first embodiment.

The skin layer 4 is provided to the matching layer 5 on the exterior side of the radome 2. The skin layer 4 is formed of high-strength glass fiber cloths 6 as reinforcement fibers impregnated with resin 7. The glass fiber cloths 6 used for the skin layer 4 have a high mechanical strength and are therefore suitable as a material forming the skin layer 4 in contact with an external environment of the radome 2. It should be noted, however, that the glass fiber cloths 6 have a high permittivity and a radio wave transmittivity decreases generally when a content of the glass fiber cloths 6 is increased. It is preferable that a content ratio of glass fibers in the skin layer is 30 to 60 wt %. Further, normal glass fibers have an E glass composition and a permittivity (1 MHz) thereof is 6.6. It is preferable for the radome of the invention that a permittivity (1 MHz) of a glass composite of the glass fiber cloths is 6 or below, and more preferably, 5 or below. An example of glass fibers having such a glass composition is commercially available from Nitta Boseki Co., Ltd., under the trade name of NE GLASS. A permittivity (1 MHz) of this glass composition is 4.6. FIG. 2 shows an example provided with three layers of the glass fiber cloths 6. It should be appreciated, however, that the number of layers is not limited to three and the glass fiber cloths 6 and resin 7 impregnated therein do not necessarily form distinct layers as is shown in the drawing. Further, the glass fiber cloths 6 may be replaced with a glass fiber mat and one mat or plural layered mats can be used. Meanwhile, a foamed material, such as a urethane material having a low permittivity or a core material having a resin impregnating property is used as the matching layer 5. FIG. 3 shows the radome 2 using a foamed material 8 as the matching layer 5.

The radome 2 having the structure shown in FIG. 3 can be manufactured by various methods. One is a method by which the skin layer 4 and the matching layer 5 made of the foamed material 8 are molded separately into a dome shape as shown in FIG. 1 first and then these layers are bonded together. In this case, in comparison with a radome of a sandwich structure in the related art in which a core material is sandwiched between two skin materials and bonded together, the fabrication sequence can be simpler because one skin layer is omitted. Another manufacturing method is as follows. That is, the matching layer 5 made of the foamed material 8 is molded into a dome shape first and the glass fiber cloths 6 or glass fiber mats are layered on the outer surface of the matching layer 5. Then, the skin layer 4 is formed by covering these layered materials with a sheet or the like and impregnating these layered materials with resin by pressure impregnation or vacuum impregnation. Still another manufacturing method is as follows. That is, a prepreg prepared by impregnating the glass fiber cloths 6 or glass fiber mats 7 with resin is placed on a dome-shaped concave molding die and the foamed material 8 formed in a dome shape is placed on the prepreg. Then, the skin layer and the matching layer are formed by impregnating the foamed material 8 and the prepreg with resin by allowing the resin to cure with heating by autoclave molding.

Figure 4:
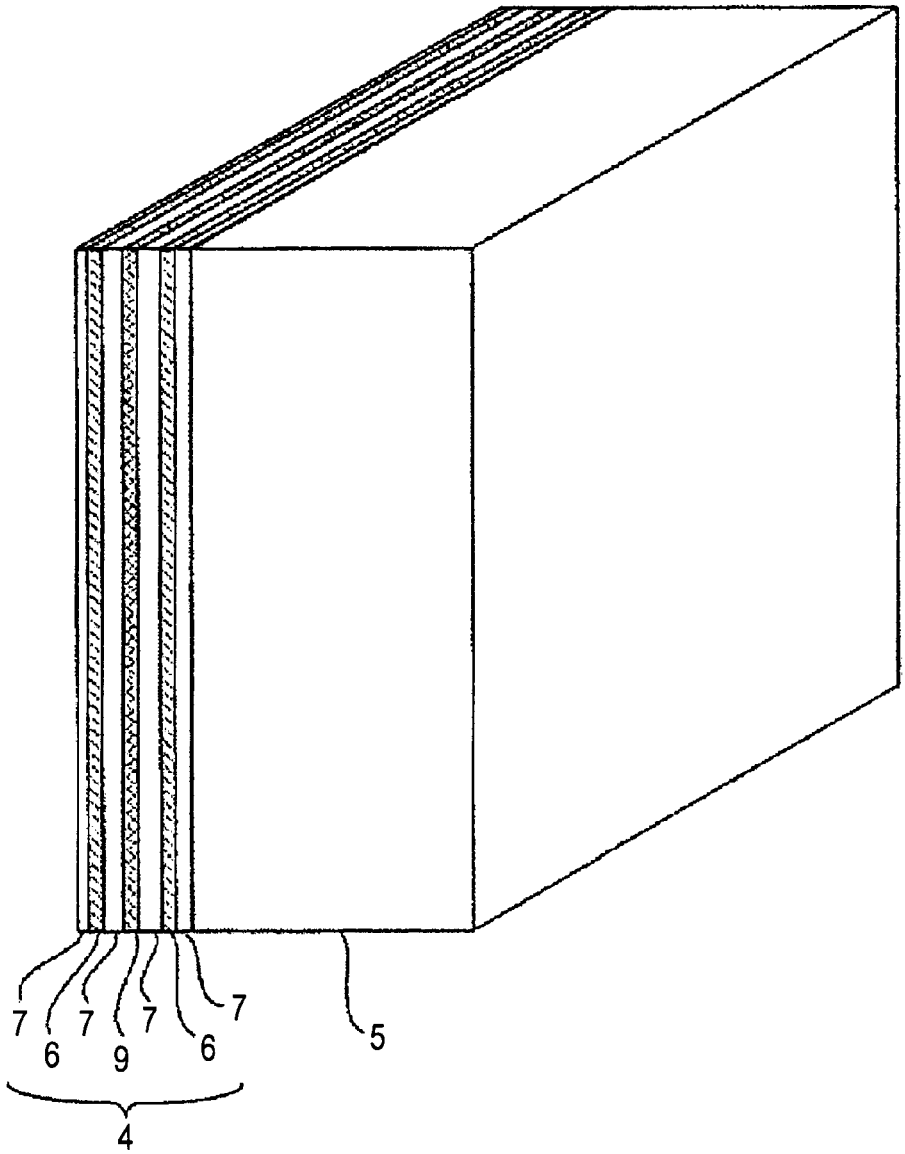
FIG. 4 is a partial perspective cross section of a radome using more than one type of fibers for a skin layer of the first embodiment.

The skin layer 4 can be formed by layering more than one type of fiber materials. This structure will be described using FIG. 4. Referring to FIG. 4, a layer obtained by overlapping the glass fiber cloths 6 on an organic reinforcement fibers 9 (hereinafter, referred to as the olefin fiber cloth 9), such as super-high-molecular olefin fibers, and by impregnating these overlapped cloths with the resin 7 is used as the skin layer 4. As the olefin fiber cloth 9, the one having a lower permittivity than the glass fiber cloths 6 and making a radio wave transmittivity of the radome 2 satisfactory can be chosen.

Assume that a radome is formed of the skin layer 4 alone without the matching layer 5, then the skin layer 4 is made of the fiber materials layered as described above and has a specific permittivity $\in r$ of 1 or higher. Meanwhile, a specific permittivity in vacuum (a specific permittivity in air is substantially the same) is 1 and reflection of radio waves occurs at the interface between the skin layer 4 and an air layer. The radome 2 of a canape structure is provided with the matching layer 5 to suppress such reflection on the skin layer 4. In order to suppress reflection on the radome, a technique of using a material having a permittivity of the ½ square of a specific permittivity of the radome itself is adopted for the matching layer (the core material sandwiched between the two skin materials) in the radome of a sandwich structure in the related art. In this case, in order to obtain a desirable specific permittivity, a foam ratio in the foamed material is changed, a different material is mixed with the foamed material, or pores or a groove is provided to the matching layer. Hence, from the viewpoints of weight, mechanical strength, manufacturability, and the cost, materials usable as the matching layer are limited. The radome of a canape structure of the invention solves this problem. For example, even in a case where a material of the matching layer 5 is determined (a specific permittivity of the matching layer is also determined) to meet the demands of a cost reduction and higher manufacturability, it becomes possible to suppress reflection on the radome by providing the matching layer 5 to the skin layer 4 on the radome interior side and setting a thickness of the matching layer 5 to a predetermined thickness according to a specific permittivity thereof and other conditions, such as a communication frequency.

The matching layer 5 can be formed by impregnating a core material with resin and allowing the resin to cure. The core material 10 having a resin impregnating property as shown in FIG. 5A can be used as the core material. The core material 10 having a resin impregnating property is a non-woven fabric combined material of a structure in which cell structures 12 are placed within a non-woven fabric 11 made of organic fibers, such as polyethylene terephthalate, so as to have clearances from one another. Each cell structure 12 has one or more than one void 12*a* defined by a partition wall in the inside and has compression resistance in a thickness direction of the non-woven fabric combined material. It is preferable that the cell structure 12 is a foamed body 13 as shown in FIG. 5B. This foamed body is foamed polyurethane or foamed polyacrylonitrile. A resin portion is the partition wall and the foamed body has one or more than one independent bubble 13*a* as the void 12*a* in the inside. The term, "independent bubble", referred to herein is a bubble inside the foamed body and also a bubble that is not continuous to the surface of the cell structure. The cell structure 12 can be an aggregate of the foamed bodies 13 and can be of a polygonal shape, such as a hexagonal column shape, or a circular cylindrical shape.

The non-woven fabric combined material as the core material 10 having a resin impregnating property may be formed by embedding foamed bodies as cell structures into a non-woven fabric or foamed bodies obtained by injecting resin containing a foaming agent into a non-woven fabric and allowing the foaming agent to make foams may be formed as the cell structure. Further, the non-woven fabric combined material may be formed by attaching the foamed bodies to the surface of a cell non-woven fabric or by sandwiching foamed bodies as the cell structures between two non-woven fabrics. The matching layer 5 is formed by impregnating the core material 10 having a resin impregnating property with rein. The foamed body as the cell structure has an independent foam (s) in the inside. Accordingly, a void not impregnated with resin is formed in the foamed body and a resin impregnated portion impregnated with resin is formed in the clearances among the respective cell structures.

Figure 5:
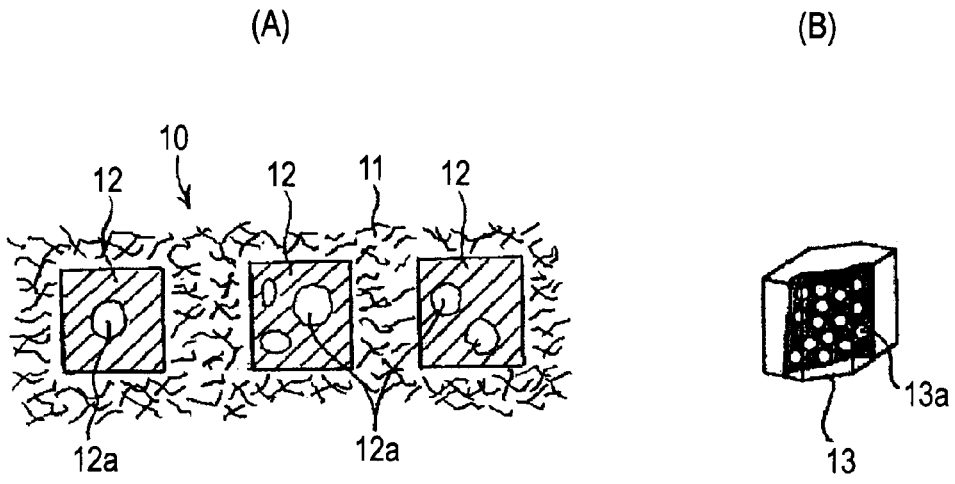
FIG. 5A is a cross section showing an entire non-woven fabric combined material as a core material having a resin impregnating property used for the matching layer of the first embodiment and FIG. 5B is a partially broken perspective view of a foamed body as a single cell structure.

A manufacturing method of the radome 2 of a canape structure in a case where the core material 10 having a resin impregnating property shown in FIG. 5 is used as the matching layer 5 can be further simpler. More specifically, it is possible to use a manufacturing method as follows. That is, the glass fiber cloths 6 or glass fiber mats are layered on a dome-shaped concave molding die and the core material 10 having a resin impregnating property before impregnated with resin is layered thereon. Then, the radome interior side of these layered materials is covered with a sheet or the like and these layered materials are vacuum impregnated with resin, so that the skin layer 4 and the matching layer 5 are formed integrally by infusion molding. In this case, because the skin layer 4 and the matching layer 5 can be impregnated with rein at a time, the manufacturing becomes easier. The skin layer 4 can be a layer obtained by layering many types of fiber materials as shown in FIG. 4. The reason why the skin layer and the matching layer can be formed integrally by infusion molding is as follows. That is, because the core material having a resin impregnating property has compression resistance in the thickness direction owing to the cell structures, and moreover, because the core material having a resin impregnating property has clearances among the respective cell structures, the core material having a resin impregnating property has excellent formativness to curved surfaces and can even secure a channel for a flow of resin during molding when the matching layer is formed. In order to let this characteristic be exerted effectively, it is preferable that the cell structures occupy 40 to 80% of the entire non-woven fabric combined material when viewed from the surface thereof. It is also preferable that an area of a single cell structure is 1 $cm^2$ or larger. It is further preferable that an interval between the respective cell structures 13 is 1 mm or larger. In addition, it is preferable that a thickness of the skin layer 4 is 1 to 4 mm, a thickness of the matching layer 5 is 2 to 20 mm, and a total thickness of the skin layer and the matching layer (a thickness of the radome of a canape structure) is 4 to 22 mm.

Example 1

Example 1 of the radome of a canape structure will be described. FIG. 6 is a list showing physical properties of the radome of a canape structure of Example 1. In Example 1, glass fiber cloths available from Nitto Boseki Co., Ltd. under the trade name of NEA2116 and olefin fiber cloths available from Toyobo Co., Ltd. under the trade name of Dyneema (registered trademark) are used for the skin layer 4. Also, a polyester fiber non-woven fabric known as Lantor Soric (registered trademark) available from LANTOR BV is used as the core material having a resin impregnating property for the matching layer 5. Regarding the thickness of the radome, the finished skin layer 4 is about 2-mm thick and the finished matching layer 5 is about 5-mm thick and a communication frequency is in the Ku bandwidth. Lantor Soric is a type of the core material having a resin impregnating property shown in FIG. 5 in which, as is described above, the skin layer 4 and the matching layer 5 are formed integrally by infusion molding by simultaneously vacuum impregnating these layers with vinyl ester resin.

The skin layer 4 is formed of two layers of glass fiber cloths, two layers of olefin fiber cloths, and two layers of glass fiber cloths. The glass fiber cloth layers have excellent tensile and bending strengths but a high permittivity. Meanwhile, the olefin fiber cloth layers have a tensile strength as good as that of the glass fiber cloth layers, and although a bending strength thereof is lower than that of the glass fiber cloth layers but a permittivity is low. Lantor Soric alone in the matching layer 5 has lower tensile and bending strengths but the strengths are increased as it is impregnated with resin and becomes more rigid owing to its thickness (about 5 mm as described above). Lantor Soric used for the matching layer 5 has a permittivity of 1.95 and vinyl ester resin impregnated therein has a permittivity of 2.72. Hence, the matching layer 5 has a lower permittivity than the skin layer 4.

Figure 7:
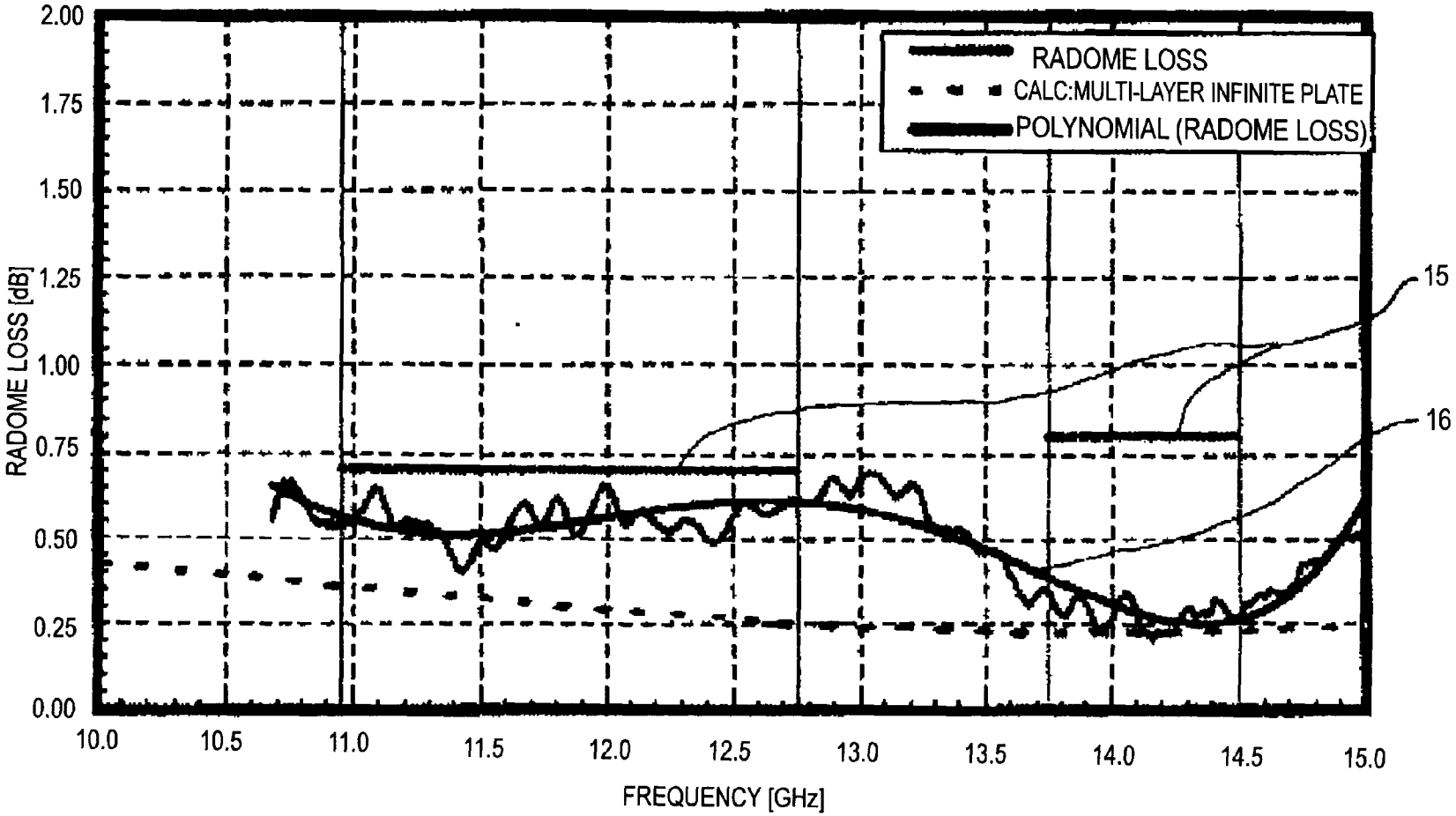
FIG. 7 is a graph showing a transmitting property of the radome according to Example 1 of the first embodiment.

FIG. 7 is a graph showing a transmission characteristic of the radome of a canape structure of Example 1. The abscissa is used for frequencies and the ordinate is used for a transmission loss. Values indicated by numeral 15 in the drawing are a loss caused by a radome formed of the skin layer 4 alone without the matching layer 5. A loss of the radome of a canape structure of the Example 1 formed of the skin layer 4 and the matching layer 5 is actual measured values indicated by numeral 16 in the drawing. Hence, it can be understood that the radio property with a smaller loss can be obtained over a broad range (10.95 GHz to 14.5 GHz) with the radome of a canape structure and an effectiveness thereof can be therefore confirmed.

DESCRIPTIONS OF SIGNS AND NUMERAL REFERENCES

1: antenna device
1*a*: reflector antenna
1*b*: supporting and driving structure
2: radome
3: radome stand
4: skin layer
5: matching layer
6: glass fiber cloth
7: resin
8: foamed material
9: olefin fiber cloth
10: non-woven fabric combined material (core material having a resin impregnating property)
11: non-woven fabric
12: cell structure
12*a*: void
13: foamed body
13*a*: independent bubble
20: radome canopy portion
30: radome body portion

The invention claimed is:

1. A radome comprising:

a skin layer shaped like a dome using a glass fiber cloth or a glass fiber mat as reinforcement fibers and formed by impregnating the reinforcement fibers with resin; and a matching layer provided integrally with the skin layer on an inner side of the dome and made of a dielectric material having a lower permittivity than the skin layer inner side of the dome, wherein the matching layer has, as a core material, a non-woven fabric combined material in which a plurality of cell structures each having compression resistance in a thickness direction are placed within or on a surface of the non-woven fabric so as to have clearances from one another, and the resin is impregnated into the clearances.

2. The radome according to claim 1, wherein the cell structures are foamed bodies.

3. The radome according to claim 1, wherein the skin layer and the matching layer are formed integrally by impregnating the skin layer and the matching layer with the resin.

4. The radome according to claim 1, wherein the skin layer includes layered olefin fiber cloths.

* * * * *